US012758022B2

(12) United States Patent
Byun

(10) Patent No.: US 12,758,022 B2
(45) Date of Patent: Oct. 13, 2026

(54) VERTICAL PULLDOWN MACHINE

(71) Applicant: NEWTECH WELLNESS CORPORATION, Gimhae-si (KR)

(72) Inventor: Hyun Jung Byun, Busan (KR)

(73) Assignee: NEWTECH WELLNESS CORPORATION, Gimhae-si (KR)

( * ) Notice: Subject to any disclaimer, the term of this patent is extended or adjusted under 35 U.S.C. 154(b) by 161 days.

(21) Appl. No.: 18/754,273

(22) Filed: Jun. 26, 2024

(65) Prior Publication Data

US 2025/0380810 A1 Dec. 18, 2025

(30) Foreign Application Priority Data

Jun. 13, 2024 (KR) ..... 10-2024-0077068

(51) Int. Cl.

| | |
|---|---|
| ***A63B 21/06*** | (2006.01) |
| ***A47C 7/50*** | (2006.01) |
| ***A47C 9/00*** | (2006.01) |
| ***A63B 21/00*** | (2006.01) |

(52) U.S. Cl.

CPC ..... *A47C 9/005* (2013.01); *A47C 7/5064* (2018.08)

(58) Field of Classification Search

CPC ..... A63B 2208/0233; A63B 21/4035; A63B 2225/09; A63B 21/159; A63B 21/0628; A63B 21/4047; A63B 21/0615; A63B 21/078; A63B 21/4049; A63B 23/12; A63B 23/1263; A63B 23/03525; A63B 23/03541

See application file for complete search history.

(56) References Cited

U.S. PATENT DOCUMENTS

| | | | | | |
|---|---|---|---|---|---|
| 4,662,631 | A * | 5/1987 | Seal | A63B 21/4029 | 482/104 |
| 5,050,873 | A * | 9/1991 | Jones | A63B 21/4047 | 482/138 |
| 5,236,406 | A * | 8/1993 | Webber | A63B 21/4047 | 482/99 |
| 5,273,504 | A * | 12/1993 | Jones | A63B 23/1263 | 482/133 |
| 5,401,227 | A * | 3/1995 | Webber | A63B 23/03566 | 482/99 |
| 5,597,257 | A * | 1/1997 | Habing | A63B 21/0628 | 482/137 |

(Continued)

FOREIGN PATENT DOCUMENTS

KR 10-2469818 B1 11/2022

*Primary Examiner* — Shin H Kim
(74) *Attorney, Agent, or Firm* — Revolution IP, PLLC

(57) ABSTRACT

A vertical pulldown machine includes: a support frame seated on a floor surface; a body frame connected to the support frame to form a support structure; a pair of weight units rotatably mounted on the body frame and mounted with a weight plate; a pair of rotating units rotatably mounted on the body frame and provided to rotate respectively at a preset distance apart; a pair of connection units provided to connect the weight unit and the rotating unit to transfer a load of the weight plate to the rotating unit and to enable length adjustment; a pair of grip units connected to one end of each of the pair of rotating units and providing a space for a user to grip; and a sitting unit connected to the support frame and disposed in front of the body frame to provide a seat unit for the user to sit.

4 Claims, 8 Drawing Sheets

(56) References Cited

U.S. PATENT DOCUMENTS 5,681,247 A * 10/1997 Webber ..... A63B 21/4047 482/137
5,683,334 A * 11/1997 Webber ..... A63B 21/154 482/137
5,807,219 A * 9/1998 Webber ..... A63B 71/0009 482/142
5,938,574 A * 8/1999 Webber ..... A63B 21/4035 482/137
5,971,895 A * 10/1999 Habing ..... A63B 21/4035 482/137
6,350,219 B1 * 2/2002 Hobson ..... A63B 21/0615 482/137
6,561,960 B2 * 5/2003 Webber ..... A63B 21/4035 482/137
7,771,323 B1 * 8/2010 Batca ..... A63B 21/4035 482/142
8,834,326 B1 * 9/2014 Fulks ..... A63B 23/0238 482/142
12,491,405 B1 * 12/2025 Hall ..... A63B 21/4047
2002/0187882 A1 * 12/2002 Morris ..... A63B 21/4035 482/92
2004/0250618 A1 * 12/2004 Keiser ..... A63B 21/4047 600/587
2005/0032611 A1 * 2/2005 Webber ..... A63B 23/1209 482/97
2005/0049121 A1 * 3/2005 Dalebout ..... A63B 21/078 482/129
2007/0117690 A1 * 5/2007 Webber ..... A63B 21/154 482/142
2007/0293377 A1 * 12/2007 Webber ..... A63B 23/03525 482/94
2008/0248929 A1 * 10/2008 Webber ..... A63B 21/0628 482/96
2019/0247700 A1 * 8/2019 Webber ..... A63B 21/4035
2019/0282851 A1 * 9/2019 Hockridge ..... A63B 21/4035
2020/0360764 A1 * 11/2020 Smith ..... A63B 21/00178
2020/0376327 A1 * 12/2020 Bissonnette ..... A63B 22/0605
2021/0197010 A1 * 7/2021 Webber ..... A63B 23/03541
2023/0045004 A1 * 2/2023 Klein ..... A63B 21/4005

* cited by examiner

VERTICAL PULLDOWN MACHINE

CROSS REFERENCE TO RELATED APPLICATION

This application claims priority from Republic of Korea Patent Application No. 10-2024-0077068, filed on Jun. 13, 2024, which is hereby incorporated by reference in its entirety.

BACKGROUND

Field

The present disclosure relates to a vertical pulldown machine, and more specifically, to a vertical pulldown machine in which a grip unit rotates in a straight line above the head of a user to increase exercise effectiveness.

Related Art

Recently, as the public has increased interest in health, it has become very easy to learn related knowledge obviously due to the development of media covering exercise postures.

However, since the price of exercise equipment is not affordable, most people pay a fee to use exercise equipment at a gym. However, when there are many people during certain times or holidays, people often wait to use the exercise equipment they want. In this regard, there is an increasing demand from many people for exercise equipment that allows many types of exercise without taking up a large space.

Conventional pulldown machines are used by many people to exercise the latissimus dorsi muscle, but there is an issue that a grip unit falls curved when performing the exercise, which reduces exercise efficiency.

Accordingly, research is required on a vertical pulldown machine that may increase exercise effectiveness by rotating the grip unit in a straight line above the head of a user.

In particular, there is a demand for the development of exercise equipment capable of deeply stimulating various parts of the back and capable of exercise movements with one arm or both arms.

RELATED ART DOCUMENT

Patent Document (Patent Document 1) Korean Patent No. 10-2469818

SUMMARY

An aspect of the present disclosure is directed to providing a vertical pulldown machine that may increase exercise effectiveness by rotating a grip unit in a straight line above the head of a user.

In addition, an aspect of the present disclosure is directed to providing a vertical pulldown machine that has a handle angle adjustment unit, so that a user may adjust a handle angle to various angles according to the needs of the user and select a grip method to allow intensive exercise targeting a specific area.

In addition, an aspect of the present disclosure is directed to providing a vertical pulldown machine that allows performing exercise by selecting one arm motion or two arm motion, thereby enabling customized motion performance according to the purpose of exercise.

In addition, an aspect of the present disclosure is directed to providing a vertical pulldown machine that may adjust the height of a seat unit, the angle of a knee support unit, and the angle and position of a chest support unit, and may correspond to the body sizes of various users.

The vertical pulldown machine according to an embodiment of the present disclosure may include: a support frame 110 seated on a floor surface; a body frame 120 connected to the support frame 110 to form a support structure; a pair of weight units 130 rotatably mounted on the body frame 120 and mounted with a weight plate; a pair of rotating units 140 rotatably mounted on the body frame 120 and provided to rotate respectively at a preset distance apart; a pair of connection units 150 provided to connect the weight unit 130 and the rotating unit 140 to transfer a load of the weight plate to the rotating unit 140 and to enable length adjustment; a pair of grip units 160 connected to one end of each of the pair of rotating units 140 and providing a space for a user to grip; and a sitting unit 170 connected to the support frame 110 and disposed in front of the body frame 120 to provide a seat unit 174 for the user to sit.

In addition, in the vertical pulldown machine according to an embodiment of the present disclosure, when a distance from one end close to the sitting unit 170 of the support frame 110 to the other end close to the body frame 120 is a width W, the center of the seat unit 174 is located within a range of 34 to 43% of the width W from one end close to the sitting unit 170, and a rotation axis of the rotating unit 140 may be located within a range of 76 to 85% of the width W from one end close to the sitting unit 170. In addition, when a distance from the floor surface to the top of the rotating unit 140 is a height H, the center of the weight plate may be located within a range of 13 to 22% of the height H from the floor surface, the rotation axis of the rotating unit 140 may be located within a range of 63 to 72% of the height H from the floor surface, and the grip unit 160 may be located within a range of 76 to 85% of the height H from the floor surface.

In addition, the body frame 120 according to an embodiment of the present disclosure may include: a standing frame 121 standing up from the support frame 110; a pair of parallel frames 122 disposed parallel to the standing frame 121; a pair of inclined frames 123 extending from an upper end of each of the pair of parallel frames 122, one end of which is connected to the standing frame 121; a parallel connection frame 124 vertically connecting the pair of parallel frames 122; a standing connection frame 125 vertically connecting the pair of standing frames 121; and a connection frame 126 connected through one point of the pair of standing frames 121 and bent at the center at a preset angle.

In addition, the rotating unit 140 according to an embodiment of the present disclosure may include: a first rotating frame 141 that has two curved units and is provided in a frame shape; a second rotating frame 142 in a frame shape having one end coupled to a point on a side surface of the first rotating frame 141 and having two curved units; a rotating bracket 143 coupled to one end of the first rotating frame 141 and provided in a U shape; a weight 144 provided at one end of the second rotating frame 142 to balance the weight of the grip unit 160; and a connection through hole 145 passing straight through one point of both ends of the rotating bracket 143 and one point of the second rotating frame 142, wherein the connection frame 126 may pass through the connection through hole 145.

In addition, the sitting unit 170 according to an embodiment of the present disclosure may include: a first sitting frame 171 that stands up from the support frame 110 and has a curved unit; a second sitting frame 172 connecting one point of the first sitting frame 171 and the support frame 110; a footrest unit 173 that is seated on the support frame 110 and disposed on a lower side of the first sitting frame 171; a seat unit 174 that is disposed on an upper side of the footrest unit 173, is connected to the second sitting frame 172, and provides a space for a user to sit; a height adjustment unit 175 that mediates the second sitting frame 172 and the seat unit 174, and slides in a height direction along the second sitting frame 172 or is fixed to the second sitting frame 172; a knee support unit 176 mounted on the first sitting frame 171, disposed higher than the seat unit 174, and disposed above knees of the user sit on the seat unit 174; a support angle adjustment unit 177 that adjusts an angle of the knee support unit 176 with respect to the first sitting frame 171; and a chest support unit 178 that is fixed through an upper end of the first sitting frame 171, supports the chest of the sit user, and is provided to allow angle and position adjustment.

The vertical pulldown machine according to an embodiment of the present disclosure can increase exercise effectiveness by rotating the grip unit in a straight line above the head of a user.

In addition, the vertical pulldown machine according to an embodiment of the present disclosure is provided with a handle angle adjustment unit, so that a user can adjust the handle angle to various angles as needed and select a grip method to performing intensive exercise targeting a specific area.

In addition, the vertical pulldown machine according to an embodiment of the present disclosure can perform exercise by selecting one arm motion or two arm motion, allowing customized motion to be performed depending on the purpose of the exercise.

In addition, the vertical pulldown machine according to an embodiment of the present disclosure can adjust the height of the seat unit, the angle of the knee support unit, the angle and position of the chest support unit, and can correspond to the body sizes of various users.

DESCRIPTION OF EXEMPLARY EMBODIMENTS

Hereinafter, specific embodiments of the present disclosure will be described in detail with reference to the drawings. However, the spirit of the present disclosure is not limited to the presented embodiments, and those skilled in the art who understand the spirit of the present disclosure will be able to easily suggest other regressive inventions or other embodiments included within the scope of the present disclosure by adding, changing, or deleting other components within the scope of the same spirit, but this will also be said to be included within the scope of the spirit of the present disclosure.

Hereinafter, a vertical pulldown machine 100 of an embodiment of the present disclosure will be described in detail with reference to the attached FIGS. 1 to 7.

Figure 1:
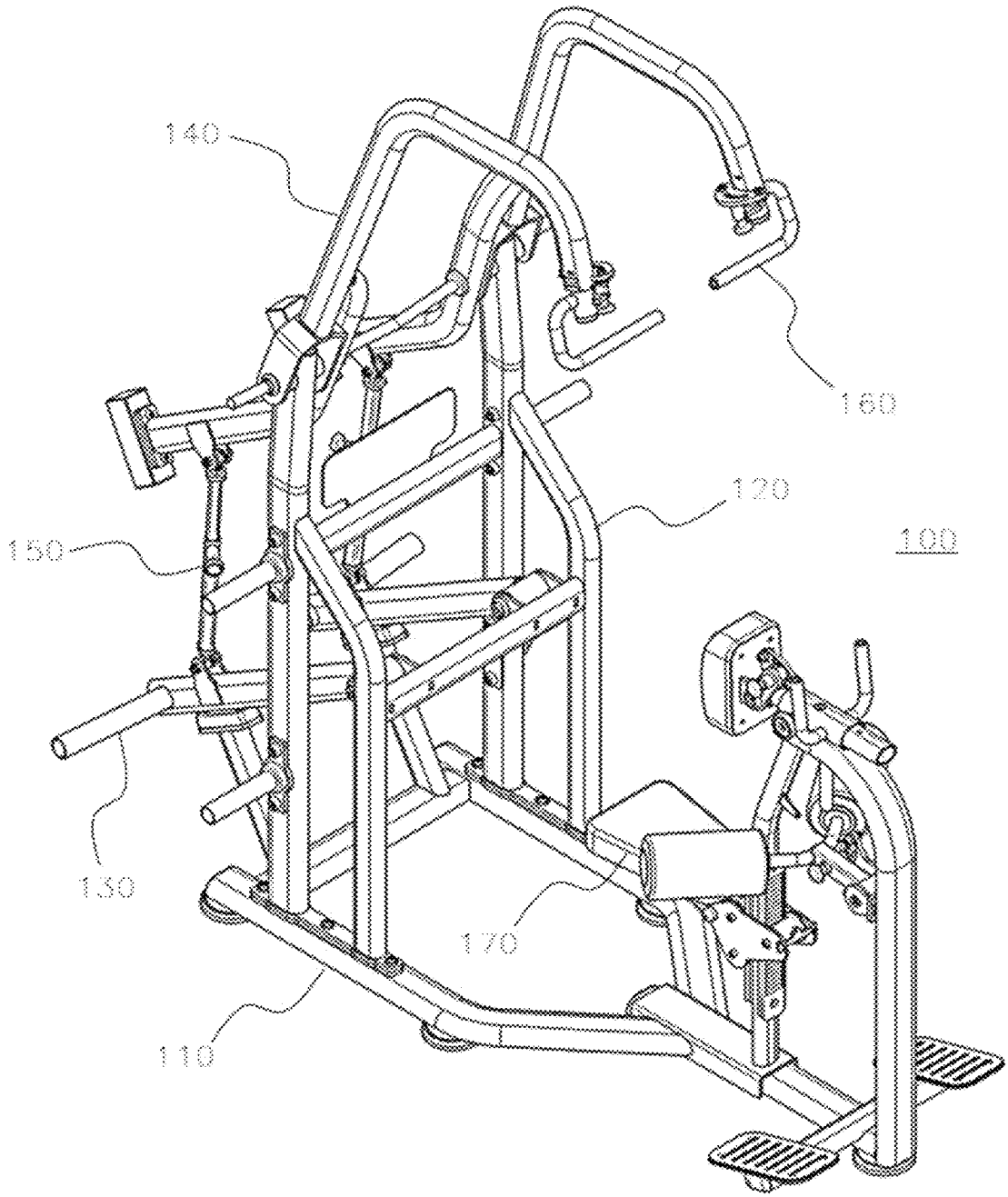
FIG. 1 is a perspective diagram illustrating a vertical pulldown machine according to an embodiment of the present disclosure.
Figure 2:
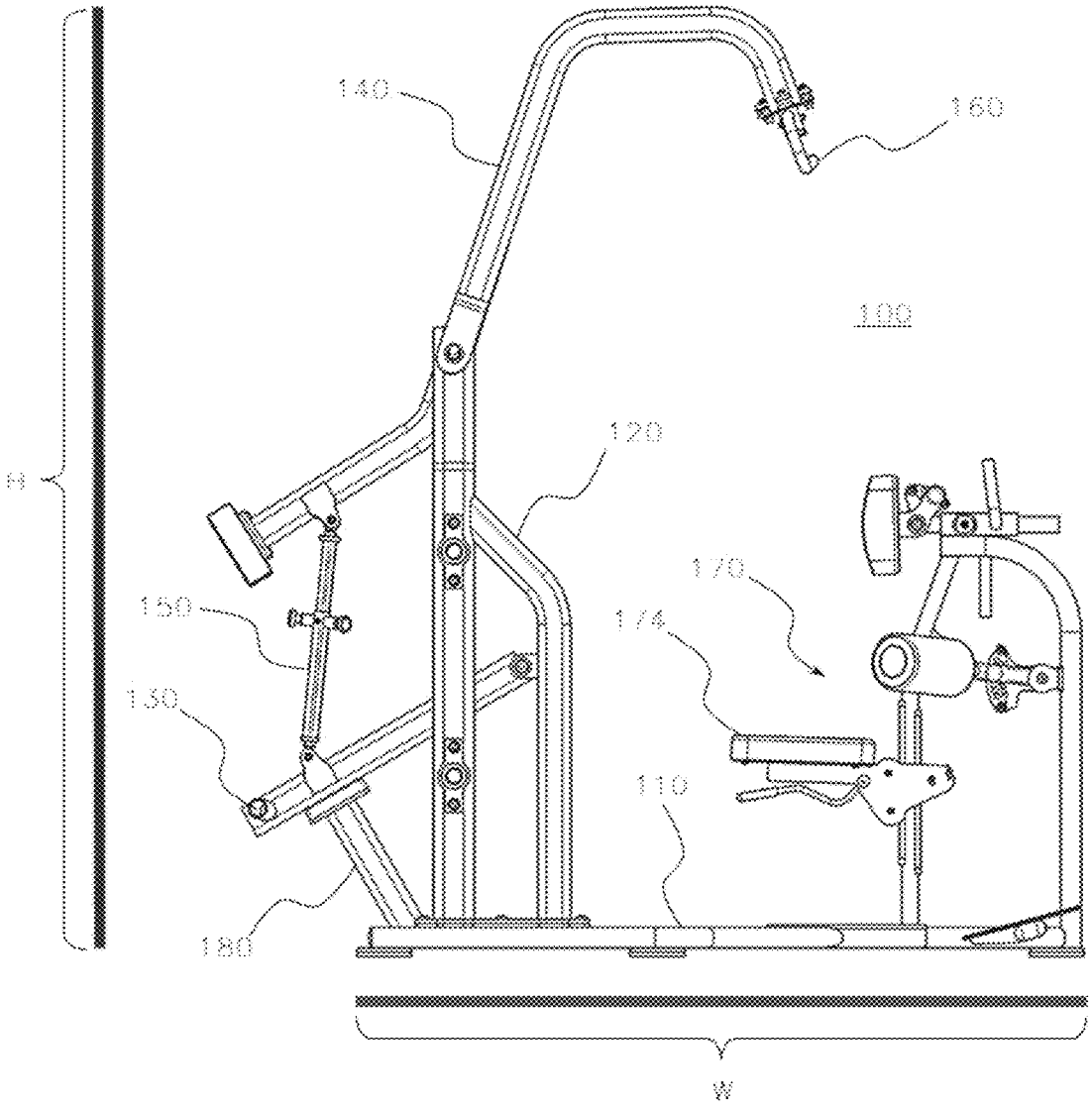
FIG. 2 is a side diagram illustrating a vertical pulldown machine according to an embodiment of the present disclosure.

FIG. 1 is a perspective diagram illustrating a vertical pulldown machine according to an embodiment of the present disclosure. FIG. 2 is a side diagram illustrating a vertical pulldown machine according to an embodiment of the present disclosure.

Referring to FIGS. 1 and 2, the vertical pulldown machine 100 according to an embodiment of the present disclosure includes a support frame 110, a body frame 120, a pair of weight units 130, a rotating unit 140, a pair of connection units 150, a pair of grip units 160, and a sitting unit 170.

The support frame 110 may be seated on a floor surface. The support frame 110 will be reviewed in more detail with reference to FIG. 3.

Figure 3:
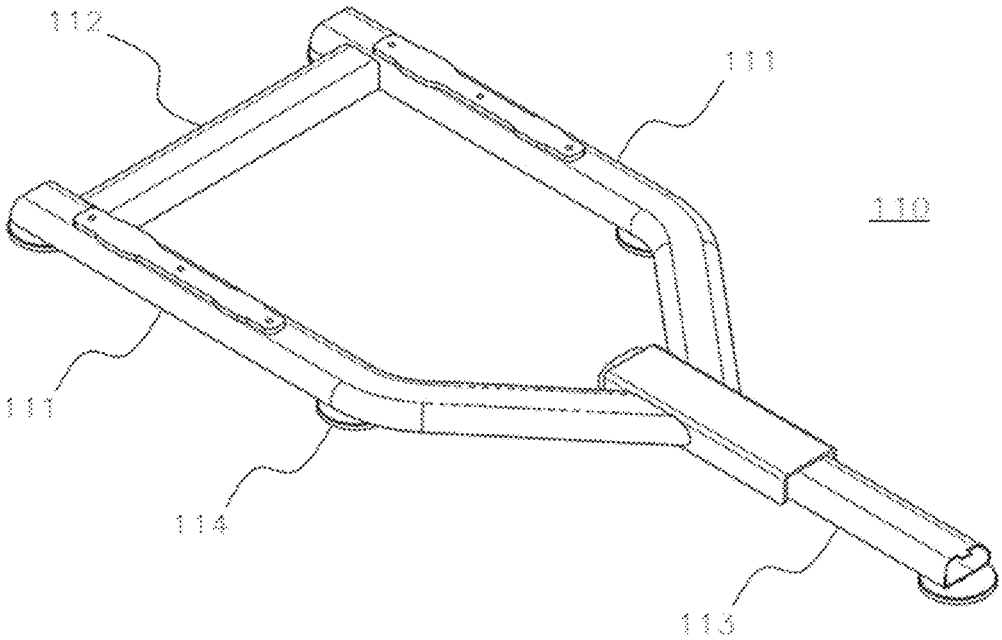
FIG. 3 is a diagram illustrating a support frame according to an embodiment of the present disclosure.

FIG. 3 is a diagram illustrating a support frame according to an embodiment of the present disclosure.

Referring to FIG. 3, the support frame 110 according to an embodiment of the present disclosure may include a support bending frame 111, a support connection frame 112, and a support protrusion frame 113.

The support bending frame 111 has one curved unit and may be disposed as a pair of mirror images.

The support connection frame 112 may vertically connect the pair of support bending frames 111.

The supporting protruding frame 113 may be provided in a bar shape between the pair of supporting bending frames 111.

The support bending frame 111, the support connection frame 112, and the support protrusion frame 113 may be provided as a skeleton frame.

The support frame 110 may be formed by connecting the support bending frame 111, the support connection frame 112, and the support protrusion frame 113 to one another.

In addition, the support frame 110 may further include friction fixing units 114 at multiple points below the support bending frame 111, the support connection frame 112, and the support protrusion frame 113.

The friction fixing unit 114 may fix the vertical pulldown machine 100 so as not to slip or move due to friction with the ground.

Referring again to FIGS. 1 and 2, the body frame 120 may be connected to the support frame 110 to form a support structure. The body frame 120 will be reviewed in more detail with reference to FIG. 4.

Figure 4:
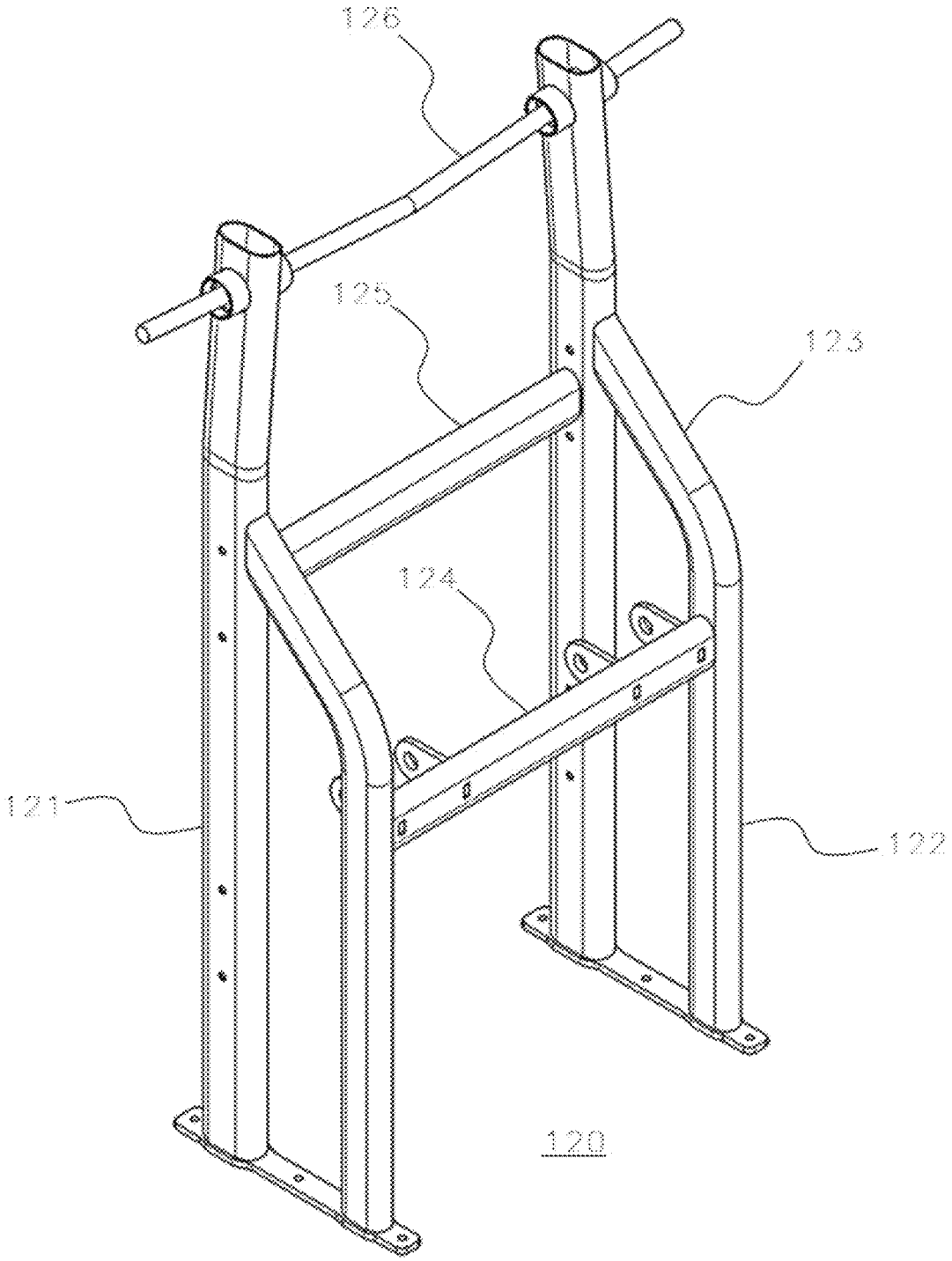
FIG. 4 is a diagram illustrating a body frame according to an embodiment of the present disclosure.

FIG. 4 is a diagram illustrating a body frame according to an embodiment of the present disclosure.

Referring to FIG. 4, the body frame 120 according to an embodiment of the present disclosure may include a standing frame 121, a pair of parallel frames 122, a pair of inclined frames 123, a parallel connection frame 124, a standing connection frame 125, and a connection frame 126.

The standing frame 121 may stand up from the support frame 110.

The pair of parallel frames 122 may be disposed parallel to the standing frame 121.

The pair of inclined frames 123 are provided to extend from an upper end of each of the pair of parallel frames 122, and one end may be connected to the standing frame 121.

The parallel connection frame 124 may vertically connect the pair of parallel frames 122.

The standing connection frame 125 may vertically connect the pair of standing frames 121.

The connection frame 126 may connect the pair of standing frames 121 by passing through one point, and the center may be bent at a preset angle.

Additionally, as shown in FIG. 1, the body frame 120 may be disposed with a weight plate storage unit (not shown) capable of holding weight plates of various weights at multiple points. The weight plate storage unit may protrude from at least one of the standing frame 121, the pair of parallel frames 122, and the pair of inclined frames 123, and may be provided so that a central hole (not shown) of the weight plate is inserted and mounted.

Referring again to FIGS. 1 and 2, the pair of weight units 130 may be rotatably mounted on the body frame 120, and the weight plate may be mounted thereon. The weight unit 130 may include a weight frame (not shown) and a pair of weight plate storage bars (not shown).

One end of the heavy frame may be link coupled to the parallel connection frame 124 so as to be rotatable.

The pair of weight plate storage bars may be provided to protrude in a bar shape on both side surfaces of the other end of the weight frame and be disposed in a mirror image with respect to the pair of weight frames, and the weight plate may be mounted.

The rotating unit 140 may be rotatably mounted on the body frame 120 and may be spaced apart from a predetermined distance. The rotating unit 140 will be reviewed in more detail with reference to FIG. 5.

Figure 5:
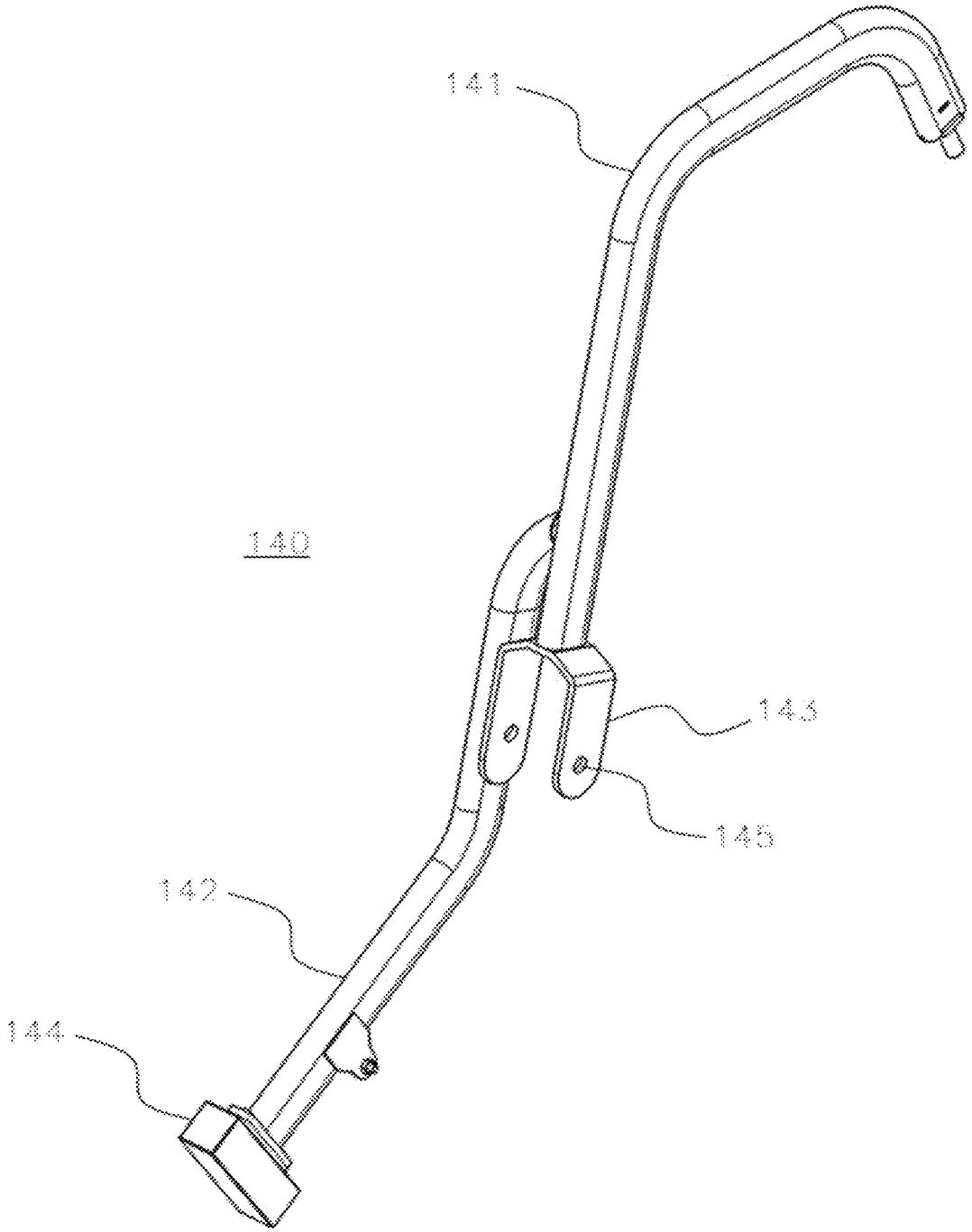
FIG. 5 is a diagram illustrating a rotating unit according to an embodiment of the present disclosure.

FIG. 5 is a diagram illustrating a rotating unit according to an embodiment of the present disclosure.

Referring to FIG. 5, the rotating unit 140 according to an embodiment of the present disclosure may include a first rotating frame 141, a second rotating frame 142, a rotating bracket 143, a weight 144, and a connection through hole 145.

The first rotating frame 141 has two curved units and may be provided in a frame shape.

The second rotating frame 142 has one end coupled to one point on a side surface of the first rotating frame 141 and may be provided in a frame shape having two curved units.

The rotating bracket 143 may be coupled to one end of the first rotating frame 141 and may be provided in a U shape.

The weight 144 may be provided at one end of the second rotating frame 142 to balance the weight with the grip unit 160. The weight 144 balances the weight of the grip unit 160, thereby preventing an accident that occurs when the grip unit 160 falls due to a load.

The connection through hole 145 may pass through one point of both ends of the rotating bracket 143 and one point of the second rotating frame 142 in a straight line. The connection frame 126 may pass through the connection through hole 145. The rotating unit 140 may rotate around the connection frame 126.

Referring again to FIGS. 1 and 2, the pair of connection units 150 may connect the weight unit 130 and the rotating unit 140 to transfer the load of the weight plate to the rotating unit 140, and may be provided so that the length may be adjusted. The connection unit 150 is provided so that the length may be adjusted, thereby controlling the distance from the weight plate, which has the benefit of allowing exercise by adjusting the weight in various ways even with the weight plate of the same weight.

The pair of grip units 160 may be connected to one end of each of the pair of rotating units 140, and may provide a space for a user to grip. Herein, the gripping space means providing a member that the user may grasp with his or her hand. The grip unit 160 will be reviewed in more detail with reference to FIG. 6.

Figure 6:
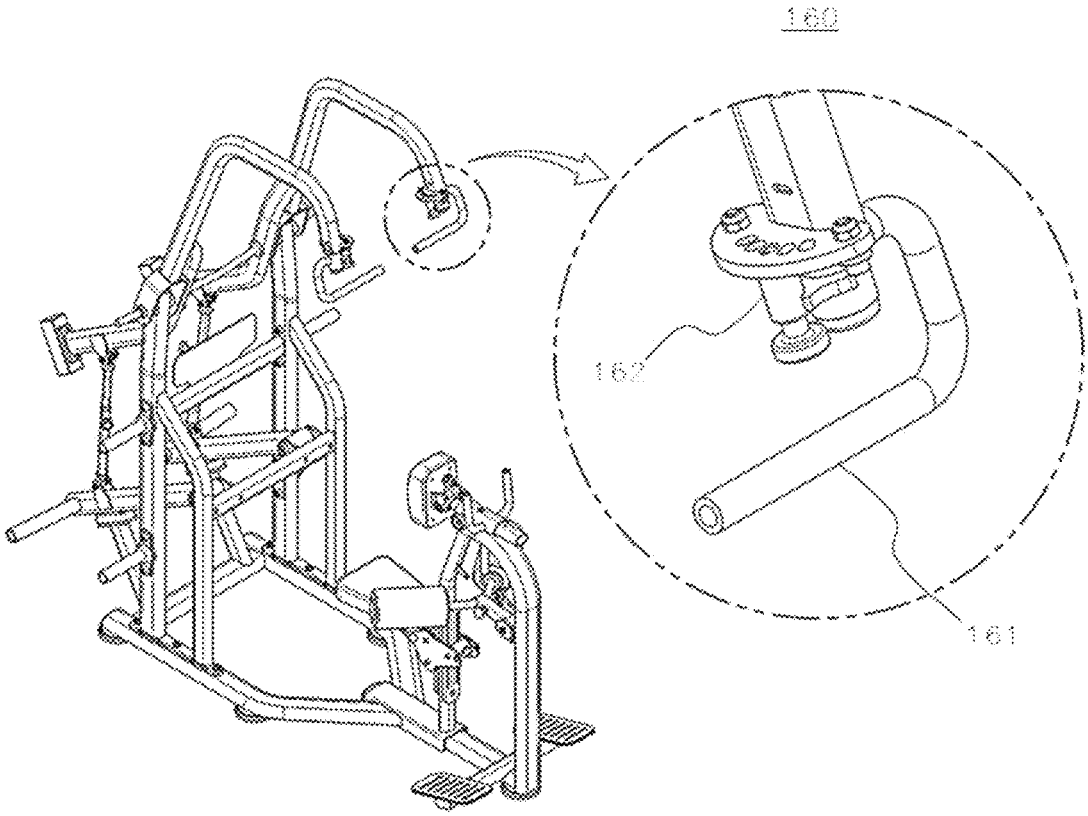
FIG. 6 is a diagram illustrating a grip unit according to an embodiment of the present disclosure.

FIG. 6 is a diagram showing a grip unit according to an embodiment of the present disclosure Referring to FIG. 6, the grip unit 160 according to an embodiment of the present disclosure may include a handle 161 and a handle angle adjustment unit 162.

The handle 161 may be provided for a user to grip, and may be provided in a 'J' shape.

The handle angle adjustment unit 162 may be provided at one end of the handle 161 and may be provided to adjust the angle of the handle 161 based on a preset axis. By providing the handle angle adjustment unit 162, a user may adjust the handle angle as needed, select a grip method, and perform intensive exercise targeting a specific area.

The sitting unit 170 may be connected to the support frame 110 and may be disposed in front of the body frame 120 to provide a space for a user to sit. The sitting unit 170 will be reviewed in more detail with reference to FIG. 7.

Figure 7:
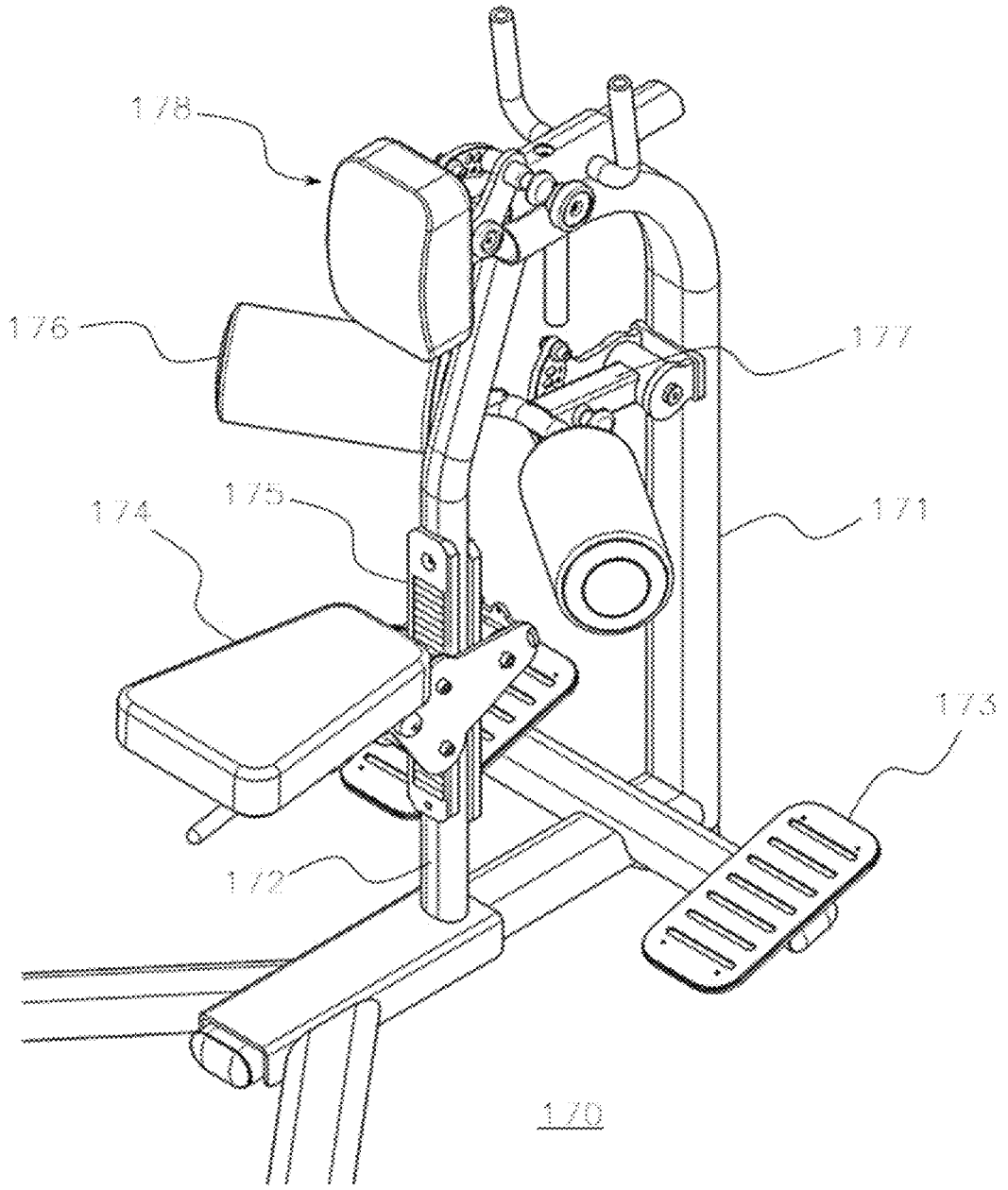
FIG. 7 is a diagram illustrating a sitting unit according to an embodiment of the present disclosure.

FIG. 7 is a diagram illustrating a sitting unit according to an embodiment of the present disclosure.

Referring again to FIG. 7, the sitting unit 170 according to an embodiment of the present disclosure may include a first sitting frame 171, a second sitting frame 172, a footrest unit 173, a seat unit 174, a height adjustment unit 175, a knee support unit 176, a support angle adjustment unit 177, and a chest support unit 178.

The first sitting frame 171 may stand up from the support frame 110 and may have a curved unit.

The second sitting frame 172 may connect one point of the first sitting frame 171 and the support frame 110.

The footrest unit 173 is seated on the support frame 110 and may be disposed on a lower side of the first sitting frame 171.

The seat unit 174 may be disposed on an upper side of the footrest unit 173, may be connected to the second sitting frame 172, and may provide a space for a user to sit. The seat unit 174 may be made of a material that allows the user to feel a cushioned feel.

The height adjustment unit 175 may mediate the second sitting frame 172 and the seat unit 174, and may slide in a height direction along the second sitting frame 172 or may be fixed to the second sitting frame 172. A user may exercise in a more comfortable state by adjusting the height adjustment unit 175 to change the height of the seat unit 174 from the floor surface.

The knee support unit 176 may be mounted on the first sitting frame 171, disposed higher than the seat unit 174, and disposed above the knees of a user sit on the seat unit 174. The knee support unit 176 may be provided with a pair of knee support pieces (not shown) and may fix both thighs or knees of the user.

The support angle adjustment unit 177 may adjust the angle of the knee support unit 176 with respect to the first sitting frame 171. The support angle adjustment unit 177 may be provided with a plurality of angle adjustment holes (not shown) in the shape of an arc, and may be adjusted to a desired angle by inserting an angle fixing pin (not shown) into one thereof.

The chest support unit 178 may be fixed through an upper end of the first sitting frame 171, may support the chest of the sit user, and may be provided to allow angle adjustment and position adjustment. By providing the support angle adjustment unit 177 and the chest support unit 178, it is possible to correspond to the body sizes of various users using the vertical pulldown machine 100.

Additionally, referring again to FIG. 2, the vertical pulldown machine 100 according to an embodiment of the present disclosure may further include a mounting unit 180.

The mounting unit 180 may be provided to protrude from a point of the support frame 110 at a preset angle and may be provided to define a lowering limit of the weight unit 130.

In addition, in the vertical pulldown machine 100 according to an embodiment of the present disclosure, when the distance from one end close to the sitting unit 170 of the support frame 110 to the other end close to the body frame 120 is a width W, the center of the seat unit 174 is located within a range of 34 to 43% of the width W from one end close to the sitting unit 170, and the rotation axis of the rotating unit 140 may be located within a range of 76 to 85% of the width W from one end close to the sitting unit 170. In addition, when the distance from the floor surface to the top of the rotating unit 140 is a height H, the center of the weight plate may be located within a range of 13 to 22% of the height H from the floor surface, the rotation axis of the rotating unit 140 may be located within a range of 63 to 72% of the height H from the floor surface, and the grip unit 160 may be located within a range of 76 to 85% of the height H from the floor surface. When the vertical pulldown machine 100 is configured under the above conditions, the grip unit may rotate in a straight line above the head of a user to increase exercise effectiveness.

Hereinafter, referring again to FIG. 8, the operation of the vertical pulldown machine 100 of an embodiment of the present disclosure will be described.

Figure 8:
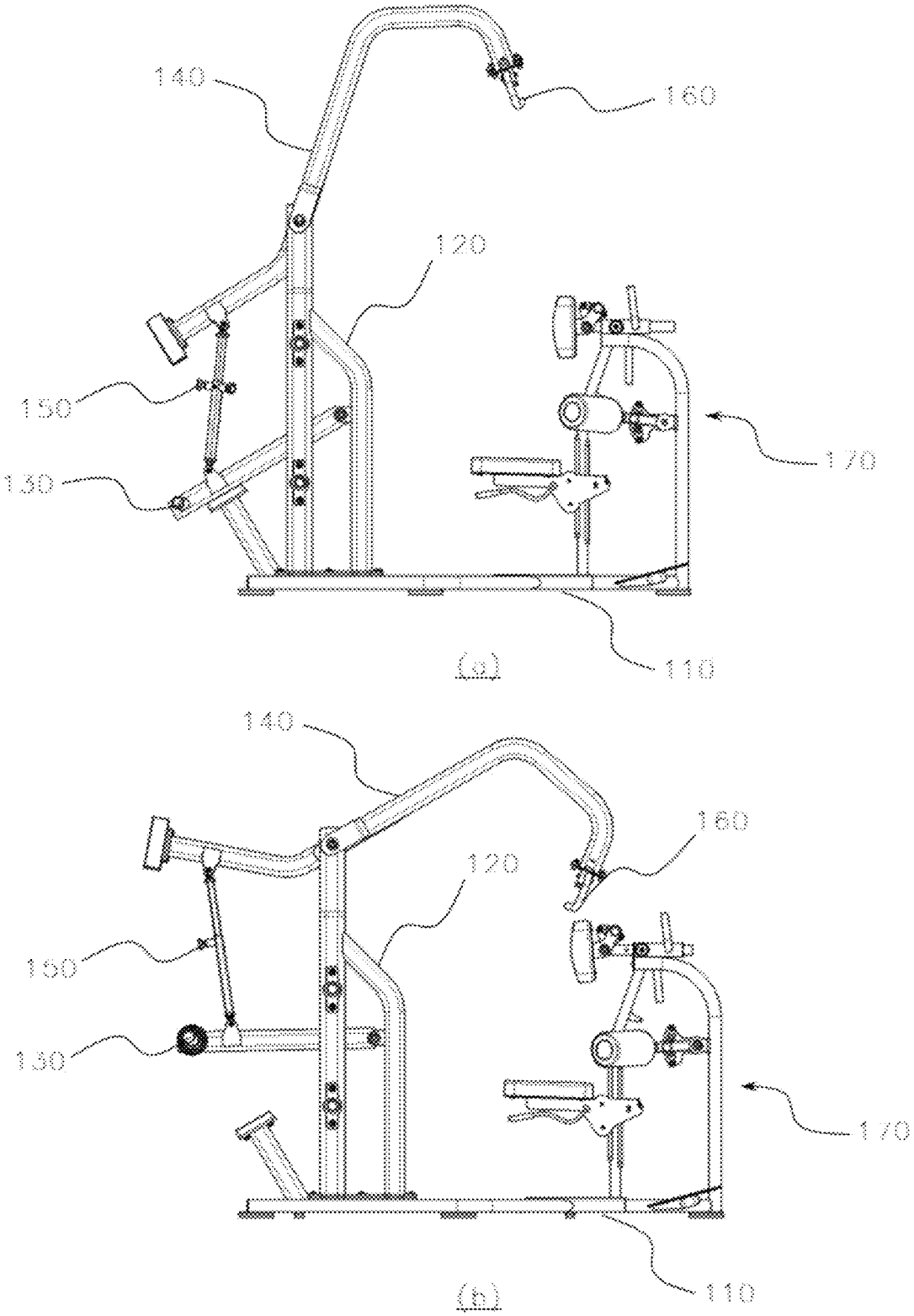
FIG. 8 is a diagram illustrating the operation of a vertical pulldown machine according to an embodiment of the present disclosure.

FIG. 8 is a diagram illustrating the operation of a vertical pulldown machine according to an embodiment of the present disclosure.

Referring to FIG. 8, FIG. 8(A) shows a state before a user lowers the grip unit 160, and 8(B) shows a state before the user lowers the grip unit 160.

First, a user may fix a weight plate of desired weight to the weight unit 130. Additionally, the handle 161 may be adjusted and fixed to a desired angle using the handle angle adjustment unit 161. Next, the user may sit on the sitting unit 170 with his/her back to the body frame 120 and adjust the height of the sitting unit 174 to suit the body size of the user. Next, the legs of the user may be fixed by adjusting the angle of the knee support unit 176 using the support angle adjustment unit 177. Depending on the needs of the user, exercise may be performed by gripping the handle 161 with one hand or both hands and lowering the grip unit 160 so that one end of the rotating unit 140 moves from the raised position (see FIG. 8(A)) to the lowered position (see FIG. 8(B)) to lift the weight plate of the weight unit 130. In addition, the aforementioned operation may be implemented while looking at the body frame 120. When the user lowers the grip unit 160 while gripping the same, the rotating unit 140 connected to the grip unit 160 rotates, and the weight unit 130 connected to the connection unit 150 is lifted according to the rotation of the rotating unit 140. When the user wants to change the weight during exercise, the user may change the weight by adjusting the length of the connection unit 50.

As described above, the vertical pulldown machine according to an embodiment of the present disclosure can increase exercise effectiveness by rotating the grip unit in a straight line above the head of a user.

In addition, the vertical pulldown machine according to an embodiment of the present disclosure is provided with a handle angle adjustment unit, so that a user can adjust the handle angle to various angles as needed and select a grip method to performing intensive exercise targeting a specific area. In addition, the vertical pulldown machine according to an embodiment of the present disclosure can perform exercise by selecting one arm motion or two arm motion, allowing customized motion to be performed depending on the purpose of the exercise.

In addition, the vertical pulldown machine according to an embodiment of the present disclosure can adjust the height of the seat unit, the angle of the knee support unit, the angle and position of the chest support unit, and can correspond to the body sizes of various users.

As described above, although embodiments of the present disclosure has been described by the limited embodiments and the drawings, the embodiments of the present disclosure are not limited to the aforementioned embodiments, but various modifications and variations can be made to the present disclosure by those of ordinary skill in the field to which the present disclosure pertains. Accordingly, embodiments of the present disclosure should be understood only by the claims set forth below, and all equivalent modifications and variations thereof will be considered to be within the scope of the spirit of the present disclosure.

DESCRIPTION OF REFERENCE NUMERALS

100: Vertical pulldown machine
110: Support frame
120: Body frame
130: Weight unit
140: Rotating unit
150: Connection unit
160: Grip unit
170: Sitting unit
180: Mounting unit

The invention claimed is:

1. A vertical pulldown machine, comprising:

a support frame seated on a floor surface;

a body frame connected to the support frame to form a support structure;

a pair of weight units rotatably mounted on the body frame and mounted with a weight plate;

a pair of rotating units rotatably mounted on the body frame and provided to rotate respectively at a preset distance apart;

a pair of connection units provided to connect the weight unit and the rotating unit to transfer a load of the weight plate to the rotating unit and to enable length adjustment;

a pair of grip units connected to one end of each of the pair of rotating units and providing a space for a user to grip; and a sitting unit connected to the support frame and disposed in front of the body frame to provide a seat unit for the user to sit, wherein when a distance from one end close to the sitting unit of the support frame to another end close to the body frame is a width W, a center of the seat unit is located within a range of 34 to 43% of the width W from one end close to the sitting unit, and a rotation axis of the rotating unit is located within a range of 76 to 85% of the width W from one end close to the sitting unit; and when a distance from the floor surface to the top of the rotating unit is a height H, a center of the weight plate is located within a range of 13 to 22% of the height H from the floor surface, the rotation axis of the rotating unit is located within a range of 63 to 72% of the height H from the floor surface, and the grip unit is located within a range of 76 to 85% of the height H from the floor surface.

2. The vertical pulldown machine of claim 1, wherein the body frame comprises:

a standing frame standing up from the support frame;

a pair of parallel frames disposed parallel to the standing frame;

a pair of inclined frames extending from an upper end of each of the pair of parallel frames, one end of which is connected to the standing frame;

a parallel connection frame vertically connecting the pair of parallel frames;

a standing connection frame vertically connecting the pair of standing frames; and a connection frame connected through one point of the pair of standing frames and bent at a center at a preset angle.

3. The vertical pulldown machine of claim 2, wherein the rotating unit comprises:

a first rotating frame that has two curved units and is provided in a frame shape;

a second rotating frame in a frame shape having one end coupled to a point on a side surface of the first rotating frame and having two curved units;

a rotating bracket coupled to one end of the first rotating frame and provided in a U shape;

a weight provided at one end of the second rotating frame to balance the weight of the grip unit; and a connection through hole passing straight through one point of both ends of the rotating bracket and one point of the second rotating frame, wherein the connection frame passes through the connection through hole.

4. The vertical pulldown machine of claim 3, wherein the sitting unit comprises:

a first sitting frame that stands up from the support frame and has a curved unit;

a second sitting frame connecting one point of the first sitting frame and the support frame;

a footrest unit that is seated on the support frame and disposed on a lower side of the first sitting frame;

a seat unit that is disposed on an upper side of the footrest unit, is connected to the second sitting frame, and provides a space for a user to sit;

a height adjustment unit that mediates the second sitting frame and the seat unit, and slides in a height direction along the second sitting frame or is fixed to the second sitting frame;

a knee support unit mounted on the first sitting frame, disposed higher than the seat unit, and disposed above knees of the user sit on the seat unit;

a support angle adjustment unit that adjusts an angle of the knee support unit with respect to the first sitting frame; and a chest support unit that is fixed through an upper end of the first sitting frame, supports the chest of the sit user, and is provided to allow angle and position adjustment.

* * * * *